US007104236B2

(12) United States Patent
Ishikawa et al.

(10) Patent No.: US 7,104,236 B2
(45) Date of Patent: Sep. 12, 2006

(54) INTAKE AIR MANAGEMENT APPARATUS FOR A VEHICLE, AND MOTORCYCLE INCLUDING SAME

(75) Inventors: Yuzuru Ishikawa, Saitama (JP); Yoshiteru Kinoshita, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 6 days.

(21) Appl. No.: 10/927,970

(22) Filed: Aug. 27, 2004

(65) Prior Publication Data

US 2005/0066926 A1 Mar. 31, 2005

(30) Foreign Application Priority Data

Sep. 30, 2003 (JP) ..... 2003-342682
Sep. 30, 2003 (JP) ..... 2003-342683

(51) Int. Cl.
*F02M 35/10* (2006.01)

(52) U.S. Cl. ..... 123/184.31; 123/195 C; 123/198 E; 55/585.3

(58) Field of Classification Search ..... 123/184.31, 123/184.32, 184.34, 184.35, 184.36, 184.42, 123/184.43, 185.51, 195 C, 195 AC, 195 P, 123/198 E, 198 D; 55/385.3
See application file for complete search history.

(56) References Cited

U.S. PATENT DOCUMENTS 4,418,676 A 12/1983 Iwao
5,813,384 A * 9/1998 Lavender et al. ..... 123/198 E
6,409,783 B1 * 6/2002 Miyajima et al. ..... 55/385.3

FOREIGN PATENT DOCUMENTS

| | | |
|---|---|---|
| EP | 0423813 | 4/1991 |
| EP | 1387081 | 2/2004 |
| JP | 64-1196 | 1/1989 |
| JP | 04-017731 | 1/1992 |
| JP | 2002160686 A | 4/2002 |

* cited by examiner

*Primary Examiner*—Willis R. Wolfe
*Assistant Examiner*—Johnny H. Hoang
(74) *Attorney, Agent, or Firm*—Carrier, Blackman & Associates, P.C.; William D. Blackman; Joseph P. Carrier

(57) ABSTRACT

An air cleaner housing includes an upper case, a partition wall and a lower case. The inside thereof is partitioned into an upper, filtered side and a lower unfiltered side. Intake funnel pipes, connected to front and rear cylinders, project into the filtered side. An air cleaner element is provided on the front side relative to a hollow plenum above the intake funnel pipes. Inlets in side surfaces of the unfiltered side face toward a V bank of the engine. During use, air enters the bottom of the housing, and is cleaned by the air cleaner element. The clean air flows through the filtered side of the housing, into the intake funnel pipes and toward the cylinders on the lower side. A raised portion is formed on the front upper side of the upper case, and the air cleaner element is disposed inside the raised portion.

8 Claims, 3 Drawing Sheets

INTAKE AIR MANAGEMENT APPARATUS FOR A VEHICLE, AND MOTORCYCLE INCLUDING SAME

CROSS-REFERENCE TO RELATED APPLICATIONS

The present invention claims priority under 35 USC 119 based on Japanese Patent Application No. 2003-342682, filed Sep. 30, 2003, and also based on Japanese Patent Application No. 2003-342683, filed Sep. 30, 2003. The complete disclosure of each of the above-referenced Japanese applications is incorporated by reference herein.

BACKGROUND OF THE INVENTION

1. Technical Field of the Invention

The present invention relates to air cleaners and to intake air routing structure for use in a motorcycle or the like, and particularly to air cleaners which incorporate throttle bodies therein.

2. Background Art

As one example of a conventional air cleaner for a V-type engine, a structure has been known in which an air cleaner is disposed below a fuel tank and above the V bank of an engine including front and rear cylinders arranged in a V shape, an air cleaner element is provided in a central portion of the air cleaner elongate in the vertical direction (see, for example, Japanese Laid-open Patent No. 2002-160686).

In this known design, a dirty air side of the air cleaner housing, connected to a lower portion of the air cleaner element, is extended into the V bank on the lower side, and a downstream side end portion of an air guide pipe is connected to the unfiltered side of the housing.

During operation of this known air cleaner, outside air is taken in from the central lower side of the air cleaner, and the air is cleaned by the air cleaner element. The flow of the filtered air is branched to the front and rear sides, and the filtered air is fed downwardly into the front and rear cylinders through throttle bodies, having upper ends connected to outlets provided at front and rear portions of a bottom portion of the air cleaner.

As another example of a conventional air cleaner structure, an air cleaner structure has been known in which an inlet for introduced air is opened in a front wall of an air cleaner housing, and a rectifying member roughly V-shaped projecting to the opening portion side in plan view is provided on the unfiltered side in the air cleaner housing at a position fronting on the inlet (see Japanese Utility Model Publication No. Sho 64-1196).

In this known design, an intake duct connected to the inlet is extended toward the front side of the vehicle body, and the front end of the intake duct is opened downwards in the vicinity of a head pipe.

In addition, there has also been known an air cleaner structure in which a throttle body of an electronic fuel injection device is disposed at a V bank of a V-type engine, and an air cleaner is connected to an upper portion of the throttle body.

In the above-mentioned air cleaner structure, it is necessary to provide a space for laying out the air cleaner element between the front and rear outlets, and to provide a space sufficient for containing the unfiltered side between the front and rear throttle bodies. However, since the positions of the outlets and the layout of the throttle bodies are limited by the bank angle of the front and rear cylinders, there are a large number of limitations as to the air cleaner element and the unfiltered side. Therefore, an air cleaner structure with few limitations exerted by the bank angle of the front and rear cylinders is desired.

In addition, since an intake device is enlarged in size when injectors are spaced from each other in the front-rear direction with the air cleaner element therebetween, it is desired to render the intake device compact.

Further, when it is intended to enlarge the volume of the air cleaner upwards so as to secure the capacity of the air cleaner, the upward enlargement is restricted because the fuel tank is enlarged along the upper side of the air cleaner housing. Moreover, where the fuel tank covers the entire region of the upper surface of the air cleaner housing, a front end portion of the air cleaner housing must be recessed, and the capacity of the air cleaner is sacrificed accordingly. Therefore, a structure making it possible to easily secure the capacity of an air cleaner having the upper side thereof covered with a fuel tank is desired. Accordingly, it is an object of the present invention to meet these demands.

Although the known vehicular air cleaners are usable for their intended purposes, a need still exists in the art for an improved air management structure for a vehicle. In particular, there is a need for an improved air management structure including an air cleaner housing having a hollow plenum therein, and an air cleaner element disposed in the housing and spaced away from the plenum.

SUMMARY OF THE INVENTION

In order to solve the above-mentioned problems, an intake air management apparatus according to a first embodiment of the invention is provided for use on a vehicle having a V-type engine, in which front and rear cylinders cooperate to form a V bank opening upwardly.

In the intake air management apparatus according to the first embodiment, an air cleaner, including an air cleaner housing and a filter element, is provided for placement above the V bank.

Air enters the housing through an opening formed therein which opens downwardly toward the V bank. The air is cleaned by an air cleaner element located inside the air cleaner housing. Front and rear intake passages, which are respectively connected to the front and rear cylinders, project into of the cleaner housing. A hollow plenum is provided above the intake passages, and the air cleaner element is provided in the air cleaner housing spaced away from the plenum.

Optionally, a plurality of fuel injectors may be provided as part of the air management apparatus, and the fuel injectors may be fixed to an upper surface of the air cleaner housing, above the intake passages.

In another embodiment hereof, a motorcycle is provided including the intake air management apparatus as described, and with an upper portion of a fuel tank abutting the rear of the air cleaner housing in an aligned relationship.

The motorcycle also includes an upper cover extending over and closely covering portions of the air cleaner housing and the fuel tank upper portion. In this embodiment, the intake air management apparatus includes a plurality of fuel injectors operatively attached to the air cleaner housing.

The air cleaner housing is formed with a recessed top wall portion on the top end thereof, and the recessed top wall portion is lowered to form an enlarged space between itself and the upper cover. The fuel injectors are housed inside the enlarged space and are operatively attached to the recessed top wall portion of the air cleaner housing.

In one embodiment of the invention, the air cleaner element is provided at a front portion in the air cleaner housing.

In another embodiment hereof, the air cleaner element is provided between portions of the V bank, outside of the axes of the intake passages.

According to the first aspect hereof, the front and rear intake passages connected to the front and rear cylinders forming the V bank project inside of the air cleaner housing, the plenum is provided above the intake passages, and the air cleaner element is disposed inside the air cleaner housing spaced apart from the plenum.

Therefore, it is unnecessary to mount the air cleaner element between the front and rear intake passages, and the air cleaner element can be disposed comparatively freely in the air cleaner housing spaced away from the plenum.

Accordingly, it is possible to determine an appropriate layout of the air cleaner element according to the layout of the intake passages and the bank angle of the engine, and to realize an air cleaner structure with few limitations by the bank angle of the V-type engine. Moreover, since the air cleaner element is not disposed in the plenum above the intake passages, the capacity of the plenum can be maintained sufficiently large, and smooth inflow of filtered air into the intake passages can be achieved.

According to the second aspect hereof, the injectors are provided at the upper surface of the air cleaner housing at the plenum portion above the intake passages. Therefore, the air cleaner element is not interposed between the injector arrangement positions, which makes it possible to narrow the interval between the injectors, and to make the intake apparatus compact. Particularly, when the front and rear intake passages are relatively inclinedly disposed, so that their axes gradually approach each other toward the upper side, the injector arrangement positions are located on the extensions of the axes, so that the interval can be further reduced.

According to a third aspect hereof, the front end portion of the upper surface of the air cleaner housing is disposed in proximity to the upper cover, so that the capacity of this portion can be enlarged. Therefore, the capacity can be easily secured in an air cleaner of the type in which the upper side of the air cleaner is apparently covered with the fuel tank.

In addition, since the upper surface of the air cleaner housing behind the front end portion of the upper surface is set lower so as to form the enlarged space between itself and the upper cover, the injectors can be disposed at the upper surface of the air cleaner housing inside the enlarged space.

Therefore, the capacity of the air cleaner housing can be secured at the front end portion of the air cleaner housing while securing the space for disposing the injectors at the upper surface of the air cleaner housing.

According to a fourth aspect of the invention, since the air cleaner element is provided at the front portion of the air cleaner housing, the space for disposing necessary component parts such as auxiliary injectors and the like can be easily secured on the rear portion side in the air cleaner housing.

According to a fifth aspect of the invention, since the air cleaner element is provided between the portions of the V bank on the outer side of the axes of the intake passages, the air cleaner element can be disposed at a lower position and in such a manner as not to interfere with the intake passage.

Figure 1:
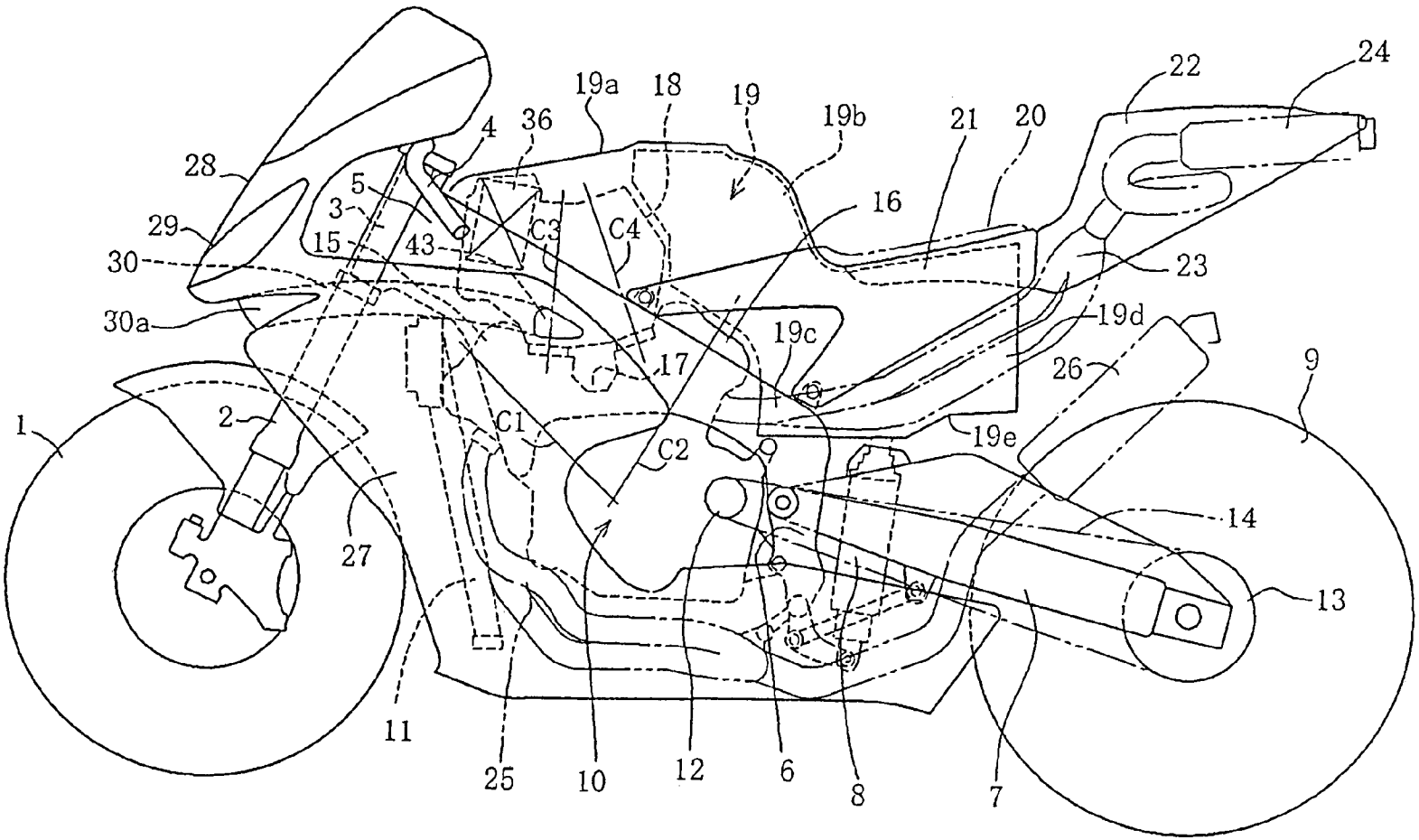
FIG. 1 is a side elevational view of a motorcycle including an intake air management apparatus according to an illustrative embodiment of the present invention.

For a more complete understanding of the present invention, the reader is referred to the following detailed description section, which should be read in conjunction with the accompanying drawings. The detailed description includes a disclosure of the best mode currently contemplated for practicing the invention. Throughout the following detailed description and in the drawings, like numbers refer to like parts.

DETAILED DESCRIPTION

Now, an embodiment will be described below based on the drawings. FIG. 1 is a side view of a motorcycle to which the present invention has been applied, in which a left-right pair of front forks 2 for supporting a front wheel 1 are provided in the vertical direction. An upper end portion of the front fork 2 is turnably supported by a head pipe 3 through a steering shaft (not shown), and is steerable via a steering handlebar 4, which is operatively connected to the front forks 2.

A left-right pair of main frame sections 5 branched to the left and right sides extend downwardly rearwards from the head pipe 3. The main frame sections 5 are formed of an appropriate metallic material such as a light alloy, and rear end portions thereof are respectively continuous with upper end portions of a left-right pair of pivot frames 6 extending in the vertical direction. A front end portion of a rear swing arm 7, constituting part of a rear wheel suspension, is swingably connected to an intermediate portion of each of the pivot frames 6.

A rear shock absorber 8, constituting part of the rear wheel suspension together with the rear swing arm 7, is disposed vertically on the front side of the rear swing arm 7. A lower end portion of the rear shock absorber 8 is mounted to a link for connecting the lower end of the pivot frame 6 and a lower portion of an intermediate portion of the rear swing arm 7 to each other, and an upper end portion of the rear shock absorber 8 is supported by a bracket provided above a front portion of the rear swing arm 7. A rear wheel 9 is supported on rear end portions of the rear swing arms 7.

A water-cooled V-type engine 10 is supported on lower portions of the main frame sections 5. A radiator 11 is supported on the front side of the V-type engine 10. A chain 14 is set in a wrapped-around state between an output sprocket 12 of the V-type engine 10 and a driven sprocket 13 of the rear wheel 9.

In the figure, symbol C1 denotes the cylinder axis of a front bank 15, and C2 denotes the cylinder axis of a rear bank 16. The cylinder axes are in a roughly V shape opening upwardly as seen in side view, and a portion between the cylinder axes C1 and C2 constitutes a valley 17 of the V bank.

An air cleaner housing 18 is disposed in the valley 17 of the V bank. Air is taken in downwards distributed to the front and right sides along intake axes C3 and C4 from the air cleaner housing 18 into cylinders on the front and rear sides. The intake axes C3 and C4 are opened wider to the lower side, as shown.

The upper side of the air cleaner housing 18 is partially covered with a fuel tank 19. A seat 20 is disposed above and behind the fuel tank 19, and is supported by seat rails 21 extending upwardly rearwards from rear portions of the main frame sections 5. The seat rails 21 are formed from an appropriate metallic material by casting or the like. The seat rails 21 include front portions which are bifurcated in side view, and tip end portions which are bolted to a stay provided on each of the main frame sections 5.

The outside shape of the motorcycle above the fuel tank 19 is given by an upper cover 19*a*. Inside of the upper cover 19*a*, the air cleaner housing 18 is contained under the front portion, while an upper portion 19*b* of the fuel tank 19 is contained unde the rear portion. The front, rear, left, right, and upper sides of the fuel tank upper portion 19*b* are covered with the upper cover 19*a*.

In appearance, the front upper cover 19*a* resembles a dummy fuel tank. This ensures that an adequately large capacity of the air cleaner housing 18 can be secured, as is necessary and sufficient.

Since the front upper portion of the fuel tank 19 is a dummy, the functioning fuel tank 19 is extended downwards and rearwards so as to secure sufficient tank capacity. Specifically, the lower side of the upper portion 19*b* extends downwards, a bottom portion thereof extends adjacent to a head cover of the rear bank 16. Further, the rear side of the fuel tank 19 extends downwards so as to constitute a lower portion front side portion 19*c*. The upper portion 19*b* and the lower portion front side portion 19*c* are continuous with lower portion rear side portion 19*d* extending rearwardly on the inside of the seat rails 21 to the vicinity of rear end portions of the seat rails 21.

The bottom side of the fuel tank 19 extends rearwardly roughly horizontally in side view from the lower portion front side portion 19*c* to reach the vicinity of an upper end portion of the rear shock absorber 8, and a relief step portion 19*e*, for accommodating upward motion of the rear swing arms 7, is provided in the range from this portion toward the rear end portion side.

A rear cowl 22 is provided behind the seat rails 21, and the front side thereof is connected to the seat rails 21 on the inside of the latter. A rear side exhaust pipe 23 extending rearwards from the rear bank 16 is disposed inside a rear portion of the rear cowl 22, and is connected to a muffler 24 projected rearwards from a rear end portion of the rear cowl 22.

In addition, a front side exhaust pipe 25 is disposed to extend from the front bank 15 to the lower side of the V-type engine 10 and then rearwards, and is connected to a muffler 26 disposed above the rear wheel 9.

A front portion of the vehicle body is covered with a front cowl 27 formed of an appropriate material such as a plastic resin. A headlight 29 is provided at an upper portion 28 of the front cowl 27 in front of the head pipe 3. An air intake port 30*a*, constituting the front end of an air guide passage 30, is opened toward the front side of the vehicle body in the vicinity of the head light 29, so as to take in a coolest running airflow from the position of a substantially frontmost portion.

A left-right branched pair of the air guide passages 30 are provided, and these passages extend rearwardly, branching to the left and right sides on the inside of the front cowl 27. The rear ends of the air guide passages 30 are connected to lower side portions of the air cleaner housing 18.

Figure 2:
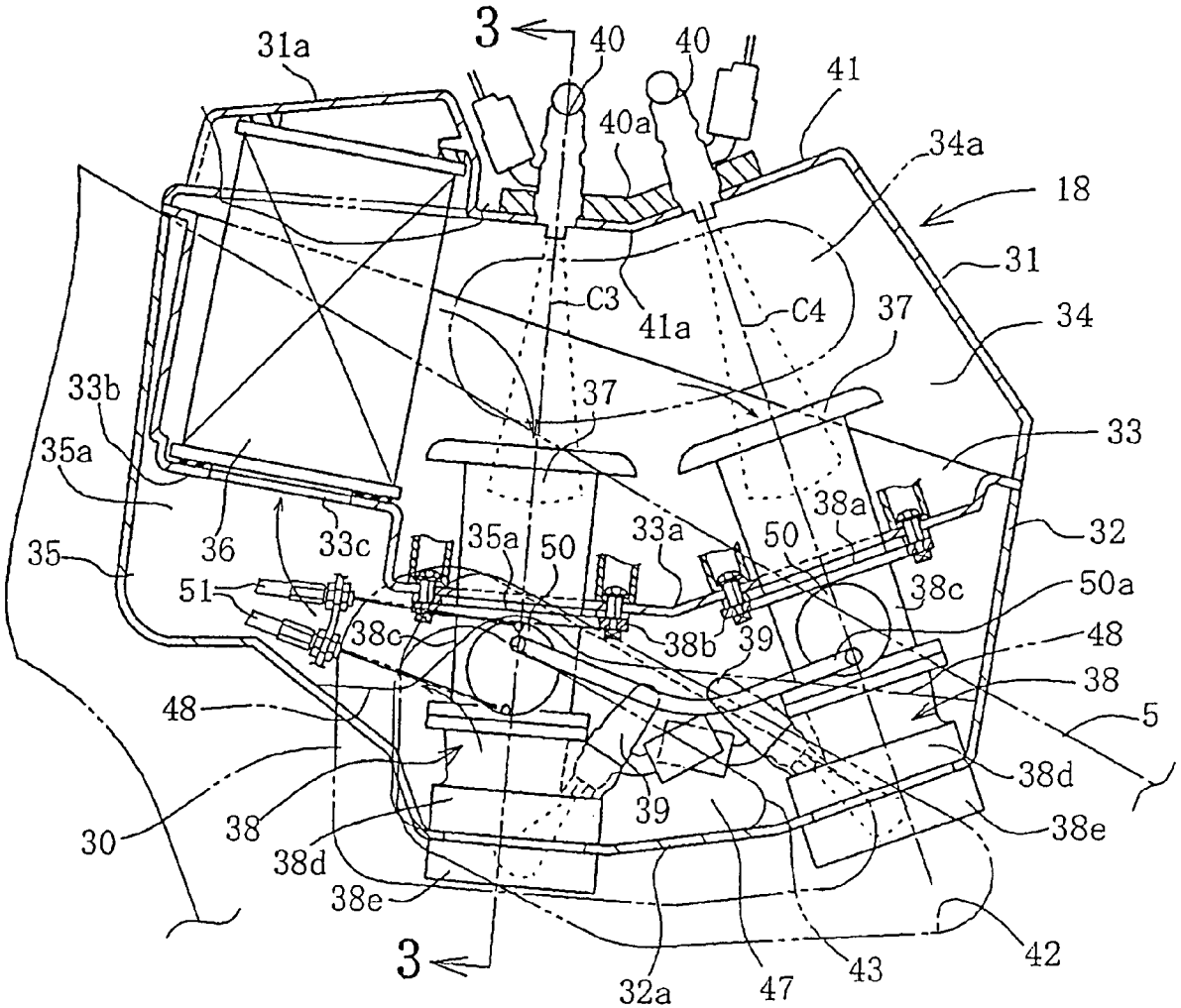
FIG. 2 is a side sectional view of an intake air management apparatus according to an illustrative embodiment of the present invention.

FIG. 2 shows a section taken along a vertical plane extending in the front-rear direction of the air cleaner housing 18, with a direction towards the front of the motorcycle indicated by the arrow F. The air cleaner housing 18 includes an upper case 31 and a lower case 32 mated with each other, with a partition wall 33 clamped between the mating portions, so that the inside of the air cleaner housing 18 is divided, by the partition wall 33, into a filtered (upper) side 34 and an unfiltered (lower) side 35. An upper end portion of the partition wall 33 is inclined downwardly rearwards in side view, as shown.

Filter elements 36 are supported on a front portion of the partition wall 33. Intake funnel pipes 37, constituting intake air passages for the engine, extend through the partition wall 33 and have bell-shaped inlets, which are contained on the filtered side 34 of the air cleaner housing 18. The bell-shaped inlets of the funnel pipes 37, on the upstream side thereof, are disposed at an intermediate height inside the filtered side 34, as shown.

The lower end of each of the respective intake funnel pipes 37 is sealingly fitted and connected to an upper end portion 38*a* of a throttle body 38, having an upper end surface in close contact with the lower surface of a bottom portion 33*a*.

A front section of the bottom portion 33*a* of the partition wall 33 is inclined rearwardly downwards, while a rear portion is inclined forwardly downwards, and an intermediate portion between the front portion and the rear portion is bent downwards to be the lowest part of the partition wall.

The intake funnel pipes 37 in the front row, provided at front portions of the bottom portion 33*a* and connected to cylinders on the front bank 15 through the throttle bodies 38, are inclined rearwardly. The intake funnel pipes 37 in the back row, provided at rear portions of the bottom portion 33*a* and used for the rear bank, are inclined forwardly, as shown.

For this reason, the intake funnel pipes 37 in the front row and the rear row are inclinedly disposed so that the interval between the intake axes C3 and C4 of the front and rear intake funnel pipes 37 is gradually reduced toward the upper side, and the front and rear intake axes C3 and C4 intersect each other at an acute angle above the air cleaner housing 18.

In addition, a reinforcing support plate 38*b* projected in the direction orthogonal to the axis from the outer circumference of an upper end portion 38*a* of each throttle body 38 is made to abut on the lower surface of the partition wall 33, and is screwed to the partition wall 33 from the upper side by use of a screw and a nut provided on the reinforcing support plate 38*b*.

The throttle bodies 38 each include an electronic fuel injection device, and are disposed on the unfiltered side 35 of the air cleaner housing 18. The throttle bodies 38 are attached to a lower portion 32*a* of the lower case 32 at lower portions 38*d* of passage portions 38*c* provided in correspondence with the individual intake funnel pipes 37, and are respectively connected to intake passages of the individual cylinders in the front bank 15 and the rear bank 16 through projected portions 38*e*, which extend downwardly from the bottom portion 32*a*.

Figure 3:
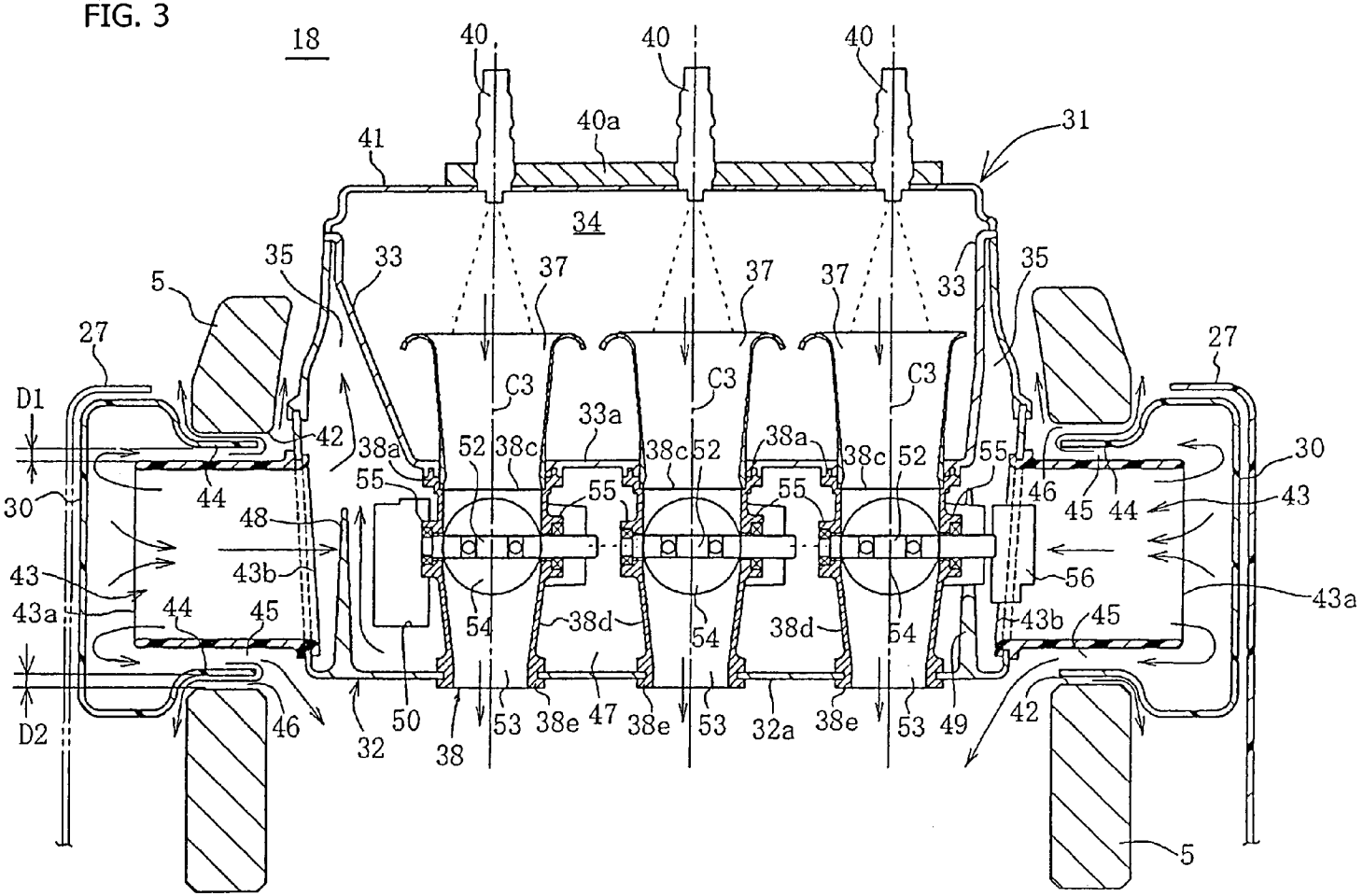
FIG. 3 is a sectional view of the air management apparatus of FIG. 2, taken along the line 3—3 in FIG. 2.

Main injectors 39 are mounted to the lower portions 38*d* of the throttle bodies 38 with the respective nozzles at their tip ends directed obliquely downwards, for electronically injecting fuel into the intake passages of the cylinders located on the downstream side of the throttle valves (see FIG. 3).

A front portion of the bottom portion 32*a* of the lower case 32, on the side of the front bank 15, is inclined rearwardly downwards, while a rear portion on the side of the rear bank 16 is inclined forwardly downwards, and an intermediate portion between the front portion and the rear portion is bent downwards to be the lowest. The axes at the passage portions 38*c* of the throttle bodies 38 are coaxially located on the downward extensions of the intake axes C3 and C4 of the front and rear intake funnel pipes 37.

The portion of the bottom portion 32*a* of the lower case 32, on the front side of the portions where the lower portions 38*d* on the front row side of the throttle bodies 38 are attached is inclined obliquely upwards, and a bottom portion 33*a* of the partition wall 33 above this inclined portion has a front side portion raised stepwise to constitute a step portion 33*b* for supporting bottom portions of the filter elements 36.

The space below the step portion 33*b* is made to be an unfiltered side front portion 35*a*, where introduced air is guided from a vent hole 33*c* provided in the step portion 33*b* into a central portion of the filter element 36.

The air cleaner elements 36 are disposed at front positions in the filtered side 34. In addition, a plurality of the air cleaner elements 36 are arrayed in the vehicle body width direction, also in the vehicle width direction.

An upper portion on the front side of the upper case 31 is projected to be raised upwardly so that the air cleaner element 36 can be contained therein, to constitute a raised portion 31*a* proximate to a front portion of the upper cover 19*a*, whereby a large-capacity space is secured on the lower side thereof, and the air cleaner element 36 is contained here.

An upper surface 41 on the rear side relative to the raised portion 31*a* of the upper case 31 is in a roughly V shape, like the bottom portion 33*a* of the partition wall 33, and a bent portion 41*a* bent to project downwards at an intermediate position constitute the lowest portion. A mount seat 40*a* similarly in a roughly V shape is fixed onto the upper surface 41, and auxiliary injectors 40 constituting part of the electronic fuel injection device are provided here on the front and rear sides. Each auxiliary injector 40 is provided coaxially with the extension of the axis C of each corresponding intake funnel pipe 37.

A discharge end portion of each auxiliary injector 40 projects into the filtered side 34, and the discharge direction is toward the center of an upper end opening portion of each intake funnel pipe 37, so that the jetted fuel as a whole, spreading on the lower side, enters into the corresponding intake funnel pipe 37. Symbol 34*a* denotes a plenum located on the filtered side 34 above the intake funnel pipes 37.

Further, the raised portion 31*a* forms a step portion raised stepwise, the upper surface on the rear side thereof forms a recessed step portion lowered stepwise, and an enlarged space 41*b* is formed between this portion and the upper cover 19*a*. The enlarged space 41*b* means a space which is enlarged as compared with the space between the upper cover 19*a* and the raised portion 31*a*.

Since the upper surface 41 fronting on the enlarged space 41*b* is formed in a V shape with a wide large obtuse angle, the auxiliary injectors 40 can be fixed toward the intake funnel pipes 37 inclined correspondingly to the front-rear V cylinders, by utilizing this portion and the enlarged space 41*b*.

With the enlarged space 41*b* provided, the upper ends of the auxiliary injectors 40 and the air cleaner element 36 are located substantially at the same height, and a compact structure can be achieved while securing the capacity in the air cleaner housing 18 as required and sufficiently.

In addition, since the upper end of the air cleaner element 36 is disposed below and in proximity to the raised portion 31*a* provided at a front end portion of the upper case 31, the space inside the air cleaner housing 18 can be utilized effectively.

Symbol 42 denotes a lightening hole opened in a side surface of the main frame 5. In the inside of the lightening hole 42, an intake duct 43 provided in a side surface of the portion on the unfiltered side 35 of the air cleaner housing 18 and the rear end of the air guide passage 30 are connected to each other. Symbol 43*b* denotes a downstream side opening of the intake duct 43, constitutes a guided air inlet in the air cleaner housing 18, as detailed in FIG. 3 later, and is opened toward the inside of the valley 17 of the V bank.

The left and right portions of a front row side portion of the throttle bodies 38 are located fronting on the downstream side opening 43*b*. Air guided through the downstream side opening 43*b* is guided into a chamber 47, which is the portion surrounding the throttle body 38, of the unfiltered side 35. Thereafter, the guided air flows from the chamber 47 to the unfiltered side front portion 35*a*, as indicated by the arrow, and into the air cleaner element 36.

FIG. 3 is a sectional view along line 3—3 of FIG. 2. The left and right intake ducts 43 project through left and right side surfaces of the portion of the unfiltered side 35 into the lightening holes 42, and the surroundings thereof are covered with rear portions of the left and right air guide passages 30.

The rear portions of the air guide passages 30 constitute inward projected portions 44 projected into the lightening holes 42. Each inward projected portion 44 is reduced in diameter so as to be located inside the corresponding lightening hole 42 with a gap therebetween.

On the other hand, the rear portion of each air guide passage 30 located on the outside of each lightening hole 42 is enlarged to such an extent that it covers a part of the lightening hole 42 where the corresponding inward projected portion 44 is located.

A clearance 45 of size D1 is provided between an outer circumferential portion of each intake duct 43 and an inner circumferential portion of each inward projected portion 44. This ensures that the unfiltered side 35 is opened to the atmosphere by communication through each intake duct 43 and the clearance 45.

In addition, a clearance 46 of size D2 is provided between an outer circumferential portion of the inward projected portion 44 of each air guide passage 30 and the wall surface fronting on the lightening hole 42 of the corresponding main frame 5. A gap is also provided between each air guide passage 30 and an upstream side opening 43*a* of each intake duct 43. This ensures that a rear end portion of each air guide passage 30 is opened to the atmosphere by communication through the inward projected portion 44 and the clearances 45 and 46. The clearances 45 and 46 are formed as annular spaces continuous with the surroundings of each intake duct 43 and the inward projected portion 44, and their sizes D1 and D2 can be arbitrarily set according to the purpose thereof.

The space between each air guide passage 30 and each intake duct 43 is opened to the atmosphere, so that when the introduced air pressure becomes too high relative to the pressure inside the unfiltered side 35, a part of the introduced air is relieved through the clearances 45 and 46 into the atmosphere. On the contrary, when the negative pressure in the unfiltered side 35 is raised and the amount of the air introduced through each air guide passage 30 is insufficient, air is replenished by sucking from the atmosphere through the clearances 45 and 46. These airflows are indicated by arrows in the figure.

On the unfiltered side 35, the space surrounding each of the throttle bodies 38 constitutes the chamber 47 functioning as the space in which the outside air introduced through the intake duct 43 stagnates. In the chamber 47, specifically in the vicinity of the downstream side opening 43*b* opened into the case of the intake duct 43 on the left side in the figure, a bulkhead 48 is integrally formed with the bottom portion 32*a* of the lower case 32. The bulkhead 48 shields the air flowing in through the downstream side opening portion 43*b* opened into the case so that the air does not collide directly against the actuator 50 (FIG. 2) of the throttle body 38.

As shown in FIG. 2, the bulkhead 48 in sectional view covers front half portions of the actuator 50 and a linkage 50*a* on the front bank side. The linkage 50*a* is a member for connecting the actuator 50 on the front bank side and the actuator 50 on the rear bank side to each other and for moving the actuator 50 on the rear bank side in conjunction with the motion of the actuator 50 on the front bank side.

Again in FIG. 3, the actuator 50 includes a drum turned by a wire cable 51 (see FIG. 2) passed through the unfiltered side front portion 35*a*, a shaft 52 operated in conjunction therewith crosses an intake passage 53, and a throttle valve 54 is integrated with the shaft 52 in the intake passage 53. The three intake passages 53 connected to the individual cylinders constituting part of the front bank are the same in structure, and a lower end portion of each intake passage 53 is connected to the intake passage for the corresponding cylinder.

Each shaft 52 is separated on the basis of each passage portion 38*c* provided therein with the intake passage 53, but each thereof is supported on an outside wall of the passage portion 38*c* through a bearing 55, and a shaft end portion is rotated in conjunction with a shaft end portion of the adjacent shaft 52 through an interlocking mechanism (not shown) such as a link mechanism.

In the chamber 47, a bulkhead 49 is similarly provided also on the right side in the figure. This bulkhead 49 is provided in the same manner as the bulkhead 48 on the left side. Since a throttle position sensor 56 is provided at a right side end portion of the shaft 52 in the rightermost passage portion 38*c*, the bulkhead 49 in this portion is disposed in proximity to the vicinity of the passage portion 38*c* located on the inner side of the throttle position sensor 56. The bulkhead 49 is provided to overlap the throttle position sensor 56, to substantially cover the portion not covered by the throttle position sensor 56.

This ensures that the throttle position sensor 56 can be utilized as a part of the bulkhead 49, and, together with the bulkhead 49, prevents dust and the like from adhering to the bearings 55 or the like.

The height of the bulkheads 48 and 49 is nearly equal to the height of the throttle bodies 38, and the upper ends thereof reach the vicinity of the bottom portion 33*a* of the partition wall 33, so that the height is effective for the bulkhead 48 and 49 to function as a shielding plate against dust and the like.

The position of the bottom portion 33*a* is located on the lower side relative to an intermediate portion in the height direction of the air cleaner housing 18. This makes it possible to secure the capacity of the filtered side 34 as required and sufficiently.

The buffer chamber 47 surrounding the throttle body 38 is formed between the bulkheads 48 and 49 and a bottom portion 33*a* of the partition wall 33 and the bottom portion 32*a* of the lower case 32. In addition, since the air cleaner elements 36 are disposed on the front side of the bulkheads 48 and 49, the chambers 47 can be formed on the side of the surroundings of the throttle bodies 38.

The chamber 47 is opened between upper end portions of the bulkheads 48, 49 and the partition wall 33, and is communicated with the unfiltered side front portion 35*a*. Therefore, in the condition where the intake negative pressure (absolute value) is comparatively small, a part of the intake air is made to stagnate in the chamber 47, and when the intake negative pressure (absolute value) is rapidly increased, air in an amount corresponding to the deficiency is momentarily supplied from the chamber 47 into the unfiltered side 35.

Since the throttle bodies 38 are incorporated by containing them in the unfiltered side 35 of the air cleaner housing 18, the surroundings of the throttle bodies 38 are covered with the air cleaner housing 18, so that the influence of dust and the like on the throttle bodies 38 can be suppressed without providing special shielding members.

Moreover, since the bulkheads 48 and 49 are provided between the downstream side openings 43*b* of the intake ducts 43 as the inlets opened in the side surfaces of the air cleaner housing 18 and the throttle bodies 38, dust and the like which may enter through the downstream side openings 43*b* together with introduced air collide first against the bulkheads 48 and 49, so that the dust and the like can be prevented from going directly toward the throttle bodies 38. Therefore, while adopting a simple structure, the throttle bodies 38 including the main injectors 39 can be prevented from being directly influenced by the dust and the like coming in from the exterior.

In addition, since the actuator 50 is disposed between the bulkhead 48 and the throttle body 38, the influence of dust and the like on the actuator 50 can also be effectively restrained by the bulkhead 48, without need to provide a special shielding member. Besides, the throttle bodies 38 for a plurality of cylinders are disposed in a pattern elongate in the left-right direction.

Since the actuator 50 and the like are provided on both sides of the throttle bodies 38 and the downstream side opening 43*b* are opened in the side surfaces of the lower case 32, dust and the like can be effectively shielded, even when the bulkheads 48 and 49 are comparatively small in area. In addition, the throttle position sensor 56 can be utilized as a part of the function of the bulkhead 49.

Besides, since the air intake port 30*a* constituting part of the front end of the air guide passage 30 is opened in the upper portion 28 of the front cowl 27 toward the front side of the vehicle body, the coolest running airflow can be taken in from substantially the frontmost portion of the vehicle body into the air cleaner housing 18 to contribute to enhancement of the output of the engine, and the influence of dust and the like on the throttle bodies 38 can be effectively prevented.

Further, the space surrounded by the bulkheads 48, 49, the bottom portion 33*a* of the partition wall 33 and the bottom portion 32*a* of the lower case 32 is made to be the chamber 47 and introduced air is guided into the chamber 47, the chambers 47 can be utilized as a buffer space, whereby even large relative variations in the introduced air pressure and the intake negative pressure exerted on the inside of the air cleaner housing 18 can be buffered by the chamber 47. In addition, the space for laying out the throttle bodies 38 can be effectively utilized as the chamber 47.

Moreover, the inside of the unfiltered side 35 is partitioned into the chamber 47 and the unfiltered side front portion 35*a*, and the outside air is first introduced into the chamber 47, whereby the buffer action is made effective. In this case, since the clearances 45 and 46 are provided between the air guide passage 30 and the intake duct 43 and the lightening hole 42, for opening into the atmosphere, the buffer effect can be made more conspicuous.

In addition, since the chamber 47 an the unfiltered side front portion 35*a* are disposed along the front-rear direction, layout of the unfiltered side 35 can be achieved without considerably enlarging the entire part of the air cleaner housing 18, and the capacity of the unfiltered side front portion 35*a* can be secured sufficiently.

Next, the functions of this embodiment will be described. First, the front and rear intake funnel pipes 37, as the intake passages connected to the opposed cylinders in the front bank 15 and the rear bank 16 forming the V bank, project into the filtered side 34, and the space is provided above the intake funnel pipes 37. The air cleaner element 36 is provided at an upper portion of the inside of the air cleaner housing 18 at other place than the space.

For this reason, it is unnecessary to fixingly dispose the air cleaner element 36 between the front and rear intake funnel pipes 37, and it is possible to freely determine an appropriate position of the air cleaner element 36 according to the layout of the intake funnel pipes 37 and the bank angle of the engine. Therefore, an air cleaner structure with few limitations exerted by the bank angle of the V-type engine can be achieved.

In addition, since the auxiliary injectors 40 are provided at the upper surface 41 of the air cleaner housing 18 forming the enlarged space 41*b* between itself and the upper cover 19*a*, the arrangement positions of the auxiliary injectors 40 are located on the extensions of the axes C of the intake funnel pipes 37 for the front and rear opposed cylinders inclined relative to each other so as to gradually approach each other toward the upper side, and the interval between the front and rear axes C is narrowed. Moreover, since the auxiliary injectors 40 are not disposed with the air cleaner element 36 therebetween, the distance between the auxiliary injectors 40 is minimized. This makes it possible to render the intake device compact.

Further, with the front end portion of the upper surface of the air cleaner housing 18 formed as the raised portion 31*a* and disposed in proximity to the upper cover 19*a*, the capacity of the portion below the raised portion 31*a* can be enlarged, and the capacity can be easily secured even in an air cleaner of the type in which the upper side of the air cleaner is apparently covered with the fuel tank.

Besides, since the air cleaner element 36 is provided at a front portion of the air cleaner housing 18, the space for disposing necessary component parts such as the auxiliary injectors 40 and the like can be easily secured on the rear portion side of the air cleaner housing 18. Particularly, since the raised portions 31*a* is provided and the upper surface 41 of the air cleaner housing 18 on the rear side thereof is made lower to form the enlarged space between itself and the upper cover 19*a*, the auxiliary injectors 40 can be disposed at the air cleaner housing upper surface 41 inside the enlarged space 41*b*.

Therefore, it is possible to secure a sufficient capacity at the front end portion of the air cleaner housing 18 while securing the space for disposing the auxiliary injectors 40, to dispose the air cleaner element 36 here, and to easily secure the capacity of the unfiltered side front portion 35*a* on the lower side thereof.

In addition, since the air cleaner element 36 is disposed at a position as low as possible by utilizing the valley 17 of the V bank formed of the front bank 15 and the rear bank 16, and is provided on the outside of the intake axis C3 of the intake funnel pipe 37 serving as the intake passage, the air cleaner element 36 can be disposed at a lower position and in such a manner as not to interfere with the intake passages.

Although the present invention has been described herein with respect to a number of specific illustrative embodiments, the foregoing description is intended to illustrate, rather than to limit the invention. Those skilled in the art will realize that many modifications of the preferred embodiment could be made which would be operable. All such modifications, which are within the scope of the claims, are intended to be within the scope and spirit of the present invention.

What is claimed is:

1. An air management apparatus adapted for use with a V-type engine in which front and rear cylinders extend upwardly and cooperate to form a V bank, said apparatus comprising:

an air cleaner configured to fit between said front and rear cylinders above said V bank, said air cleaner comprising an air cleaner housing having a downwardly-facing opening formed in a base portion thereof for drawing air therethrough, an air cleaner element mounted inside of said air cleaner housing, and a plurality of fuel injectors operatively attached to said air cleaner housing, wherein:

said air cleaner housing has front and rear intake passages formed therein for respectively connecting to said front and rear cylinders, said intake passages projecting into the inside of said air cleaner housing, a hollow plenum is provided in the air cleaner housing above said intake passages, said injectors are located above said plenum so as to be substantially opposite said intake passages, and said air cleaner element is spaced away from said plenum in said air cleaner housing.

2. An air management apparatus as set forth in claim 1, wherein said air cleaner element is provided at a front portion of said air cleaner housing.

3. An air management apparatus as set forth in claim 1, wherein said air cleaner element is provided outside of the axes of said intake passages and between portions of said V bank.

4. A motorcycle, comprising:

a frame;

a V-type engine mounted on said frame, in which front and rear cylinders extend upwardly and cooperate to form a V bank;

an air cleaner configured to fit between said front and rear cylinders above said V bank, said air cleaner comprising an air cleaner housing having a downwardly-facing opening formed in a base portion thereof for drawing air therethrough, and an air cleaner element mounted inside of said air cleaner housing, wherein said air cleaner housing has front and rear intake passages formed therein for respectively connecting to said front and rear cylinders, said intake passages projecting into the inside of said air cleaner housing, a hollow plenum is provided in the air cleaner housing above said intake passages, and said air cleaner element is spaced away from said plenum in said air cleaner housing;

a fuel tank having an upper portion in abutting contact with a rear surface of said air cleaner housing in an aligned relationship;

an upper cover extending over and closely covering portions of said air cleaner housing and said fuel tank upper portion; and a plurality of fuel injectors;

wherein said air cleaner housing is formed with a recessed top wall portion on the top end thereof, said recessed top wall portion lowered so as to form an enlarged space between itself and said upper cover, and wherein the fuel injectors are housed inside said enlarged space and are operatively attached to said recessed top wall portion of said air cleaner housing.

5. A motorcycle, comprising:

a frame;

a V-type engine mounted on said frame, in which front and rear cylinders extend upwardly and cooperate to form a V bank;

an air cleaner configured to fit between said front and rear cylinders above said V bank, said air cleaner comprising an air cleaner housing having a downwardly-facing opening formed in a base portion thereof for drawing air therethrough, an air cleaner element mounted inside of said air cleaner housing, a fuel tank having an upper portion in abutting contact with a rear surface of said air cleaner housing in an aligned relationship;

an upper cover extending over and closely covering portions of said air cleaner housing and said fuel tank upper portion; and a plurality of fuel injectors; wherein said air cleaner housing has front and rear intake passages formed therein for respectively connecting to said front and rear cylinders, said intake passages projecting into the inside of said air cleaner housing, a hollow plenum is provided in the air cleaner housing above said intake passages, said air cleaner element is spaced away from said plenum in said air cleaner housing, and said air cleaner housing is formed with a recessed top wall portion on the top end thereof, said recessed top wall portion lowered so as to form an enlarged space between itself and said upper cover, and wherein the fuel injectors are housed inside said enlarged space and are operatively attached to said recessed top wall portion of said air cleaner housing.

6. A motorcycle, comprising:

a frame;

a V-type engine mounted on said frame, in which front and rear cylinders extend upwardly and cooperate to form a V bank;

an air cleaner configured to fit between said front and rear cylinders above said V bank, said air cleaner comprising an air cleaner housing having a downwardly-facing opening formed in a base portion thereof for drawing air therethrough, an air cleaner element mounted inside of said air cleaner housing, and a plurality of fuel injectors operatively attached to said air cleaner housing, wherein:

said air cleaner housing has front and rear intake passages formed therein for respectively connecting to said front and rear cylinders, said intake passages projecting into the inside of said air cleaner housing, a hollow plenum is provided in the air cleaner housing above said intake passage, said injectors are located above said plenum so as to be substantially opposite said intake passages, and said air cleaner element is spaced away from said plenum in said air cleaner housing.

7. The motorcycle of claim 6, wherein said air cleaner element is provided at a front portion of said air cleaner housing.

8. The motorcycle of claim 6, wherein said air cleaner element is disposed outside of the axes of said intake passages and between portions of said V bank.

* * * * *